United States Patent [19]

Cheng

[11] Patent Number: 5,044,234

[45] Date of Patent: Sep. 3, 1991

[54] ELECTRICAL SCREWDRIVER

[76] Inventor: Chuan-Yi Cheng, No. 91, Ln. 35, Dong Hsin Rd., Keelung, Taiwan

[21] Appl. No.: 492,193

[22] Filed: Mar. 13, 1990

[51] Int. Cl.[5] ..... B25B 23/151

[52] U.S. Cl. ..... 81/469; 81/473

[58] Field of Search ..... 81/467, 469, 473–476; 173/12

[56] References Cited

U.S. PATENT DOCUMENTS 4,064,948 12/1977 Bratt et al. ..... 173/12
4,458,565 7/1984 Zilly et al. ..... 81/469

FOREIGN PATENT DOCUMENTS 46-41998 8/1971 Japan ..... 81/475
1568952 6/1980 United Kingdom ..... 81/474

*Primary Examiner*—D. S. Meislin
*Attorney, Agent, or Firm*—Browdy and Neimark

[57] ABSTRACT

An electrical screwdriver capable of powering off automatically when a screw is tightened which may be operated either by a manually controlled switch or by a contact-artuation switch while the twisting force required in tightening a screw may be adjusted. When the screwdriver is pushed forward, a main shaft thereof will receive a resistance and pushes a wound end of a steel wire passing through each parts thereof and causes the other end of the wire to touch a first contact switch controlling a motor contained in the handle of the screwdriver, and thereby causes the main shaft to rotate. When the screw is tightened, the rotation head of the screwdriver will push the clutch forward and causes two spring plates in the handle to recover their downward inclined position and separate from a second contact switch controlling the supply of power. An adjusting sleeve and two adjusting screws may be used to set the screwdriver to a manually controlled operation mode by fixing the adjusting sleeve to a position near the back side. A rotation collar and a slidable member with scales indicating torsion value, together with a compression spring between them may control and decide the twisting force required in tightening a screw.

3 Claims, 5 Drawing Sheets

ELECTRICAL SCREWDRIVER

BACKGROUND OF THE INVENTION

The prior electrical screwdrivers have not been capable of powering off automatically when a screw is tightened. The above-mentioned purpose can be achieved only by manually switching off the screwdriver. Therefore, good control over the operation of a conventional electrical screwdriver will greatly depend upon the experiences of users in this field. It will apparently reduce working efficiency as well as the accuracy and quality of screwing.

It is therefore, the applicant of this invention to develop an electrical screwdriver which can be capable of powering off automatically when a screw is tightened to eliminate disadvantages existing in prior art.

SUMMARY OF THE INVENTION

It is an object of the present invention to provide an electrical screwdriver capable of powering off automatically when a screw is tightened. With this screwdriver, a manually controlled operation or a contact-actuation operation may be easily selected, and the functions such as automatic stop of rotation, adjustable twisting force, etc. my be performed.

It is another object of the present invention to provide an electrical screwdriver capable of powering off automatically when a screw is tightened, by which the friction force between a rotation head and a clutch as well as between a clutch and a transmission shaft will be minimized while a torsion with less than 5% error may be accurately set to help the operation of the screwdriver.

The present invention mainly consistss of a handle, an outer sleeve, a tiny pipe, a clutch and clutch seat, a transmission shaft, a fine steel wire with one end wound into a small compression spring, a compression spring, a slidable member, a rotation sleeve, an inner sleeve, a main shaft, an adjusting sleeve, a slidable collar, etc. A motor is contained within the handle and extends forward from there to form a rotation head which has two inward arcuate dents to just match two larger collars on the clutch before the rotation head. The clutch also has two smaller collars which can be just received and clamped by a dented rear end of the transmission shaft located before the clutch and its seat. The main shaft has a smaller diameter rear portion which passes through a central hole of the inner sleeve and a central hole of the slidable member, and pushes against the small compression spring formed at one end of the fine steel wire before it inserts into a blind hole formed at the front portion of the transmission shaft. The other end of the steel wire passes through a central hole formed at the bottom center of the blind hole of the transmission shaft, a central hole formed at the middle of the clutch, a tiny pipe which passes through a central hole formed at the center of the rotation head and extends into the handle to fix to a fixing cap. The wire extends out of the fixing cap and stop at somewhere before a contact switch provided in the handle to control the motor. When the screwdriver is powered on and pushed forward, the main shaft will receive a resistance and is forced to move backward, which presses he small compression spring of the fine steel wire and causes the steel wire to move backward and touches the contact switch behind its other end and makes the current to rotate the rotation head which further drives the clutch and the transmission shaft, and the main shaft to rotate simultaneously to tighten a screw.

When a screw is tightened, the two inward arcuate dents of the rotation head will keep to push the clutch forward and disengage with the clutch and consequently push the transmission shaft forward. At this point, two spring plates above the fixing cap will depress the fixing cap and the tiny pipe, accordingly, which cause the spring plates to depart from a second contact switch behind the spring plates for controlling the power supply, and the power is cut off automatically at this point.

When the screwdriver separates from the screw being tightened, the main shaft will soon stop its backward force applied on the small compression spring, which may also cause the fine steel wire to move forwardly and separate from the contact switch for controlling the rotation of the motor. At this point, the power is off and the rotation is stopped, too.

At the front portion of the inner sleeve, two L-shaped slots are formed at each side. When the adjusting sleeve is put onto the front portion of the inner sleeve, two adjusting screws may pass through two side holes on the adjusting sleeve and slide forward or backward in the L-shaped slots along with the adjusting sleeve before they are tightly screwed to the inner sleeve. When the adjusting sleeve is fixed toward the handle, the steel wire will be forced to move backward and constantly touch the motor switch which will make the main shaft keeping rotating. Therefore, before the adjusting sleeve is fixed backward, a selector at rear end of the handle should be switched to cut off the automatic power supply first, so that the contact switch connecting the steel wire becomes inoperative. At this point, only when a press rod provided at the handle is depressed to artuate another power switch, the main shaft may be rotated.

The slidable member has two backwardly extending legs, on the surface of which, scales indicating torsion values are provided, and males threads are provided on the roots of the legs. The slidable member may be inserted into the back portion of the inner sleeve with two legs just expose out of two elongated side openings formed on the inner sleeve permitting the males threads on two legs to engage with the female threads inside of the rotation collar. The turning of the rotation collar and a compression spring provided between the slidable member and the clutch seat may together decline the shift of the slidable member and thereby the force applied to the clutch seat by the compression spring, so as to set the twisting force required in tightening a screw. The value of such twisting force may be read from a clear portion of the outer sleeve by observing the scales on the slidable member.

The clutch of the present invention is consisting of two smaller collars, two larger collars and two outer rollers, they are sequentially and symmetrically put onto a central shaft. The clutch together with the clutch seat and the rotation head will produce the function of clutch. Since all the collars and rollers are rotatably movable, friction force between the inward arcuate dents on the rotation head and the collars is minimized to make the setting of torsion value more accurate.

BRIEF DESCRIPTION OF THE DRAWINGS

A specific embodiment of the invention will now be described with reference to the accompanying drawings of which

DETAILED DESCRIPTION OF THE PREFERRED EMBODIMENT

Figure 1:
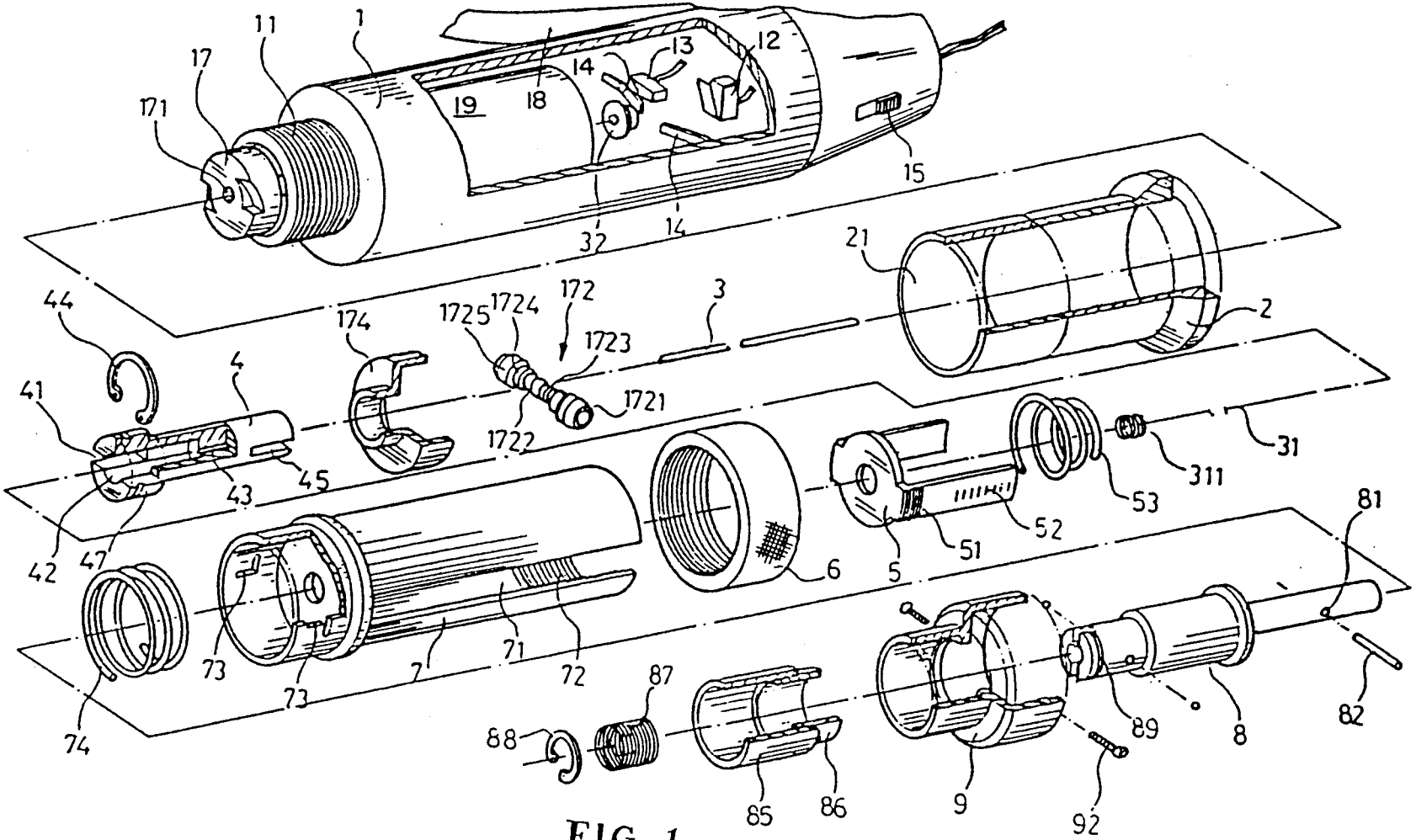
FIG. 1 is a three-dimensional analytical perspective view of the present invention showing the detailed structure of each part thereof.
Figure 2:
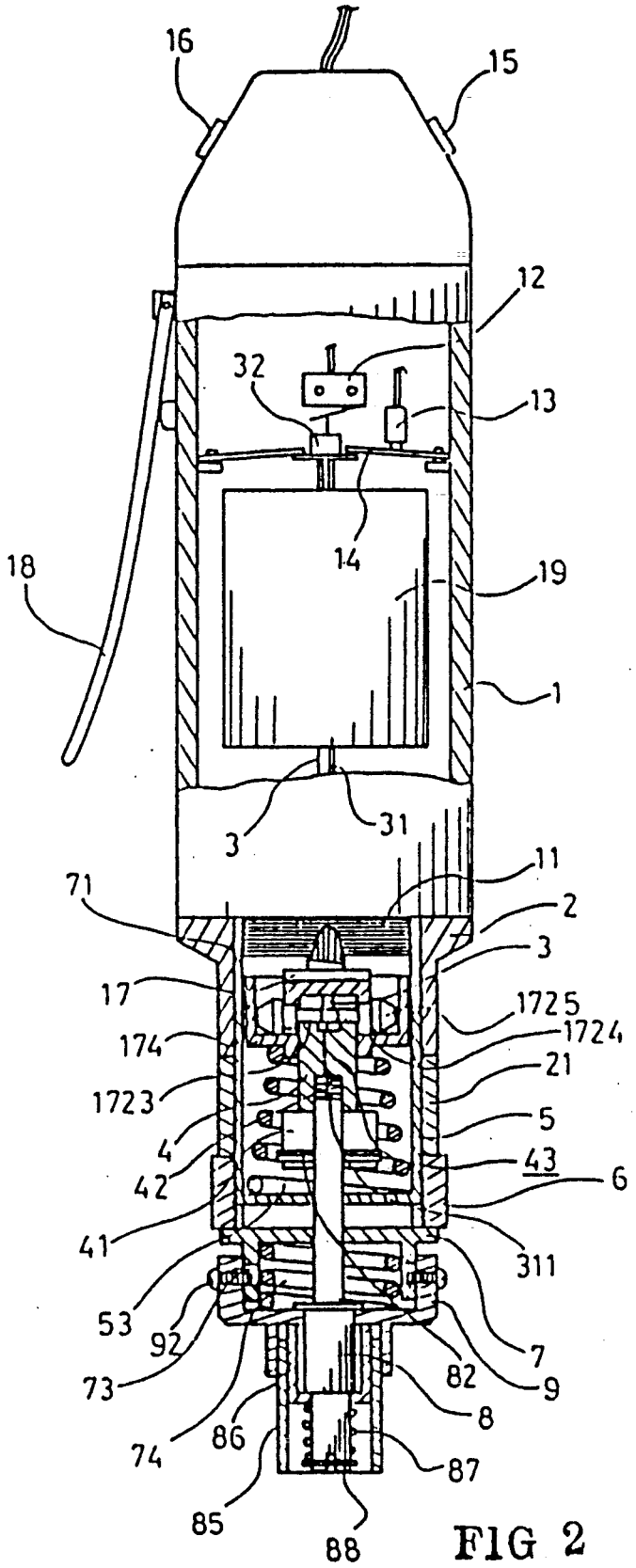
FIG. 2 is a partial longitudinal cross-sectional view of the present invention showing each part in assembled position as well as the operation in which the present invention is automatically controlled.
Figure 3:
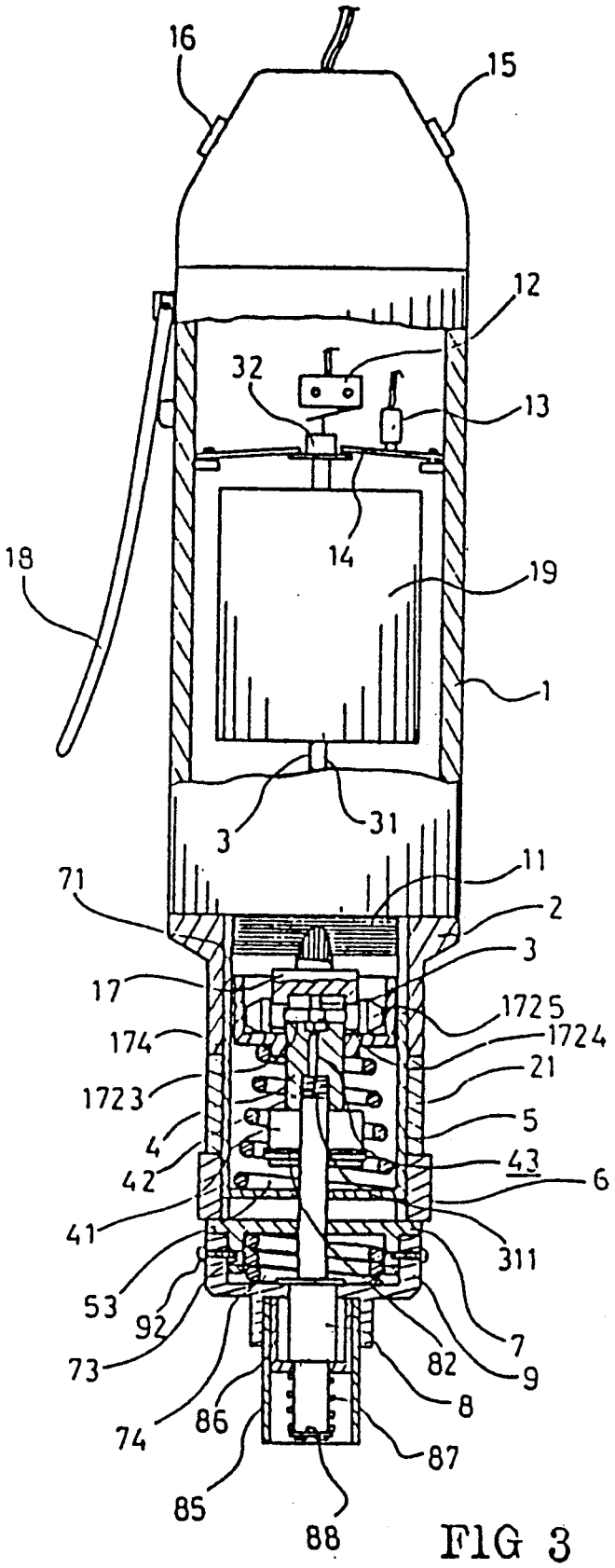
FIG. 3 is a partial longitudinal cross-sectional view of the present invention showing each part in assembled position as well as the operation in which the present invention is manually controlled.

Referring to FIGS. 1 and 2, the present invention includes a handle 1 with a motor 19 contained therein. A rotation head 17 having a central hole 171 and two inward arcuate dents at opposite ends of the head diameter extends outwardly from the front end of the handle 1 while a plurality of transmission gears are arranged between the motor 19 and the rotation head 17. A first contact switch 12 for controlling the rotation of motor 19 is provided on the central line of the handle at a position near the rear portion thereof.

Two spring plates 14 forwardly and radially extending from two inner sides of the handle 1 are properly provided before the contact 12. A second contact switch 13 is properly provided behind one of the spring plates 14 for controlling the power supply. At the rear end outside of the handle 1, a first switch 15 is provided to control the rotation of the motor 19; and a second switch 16 is provided at the first switch 15 for selecting operation either by manual control or by automatic control.

A main shaft 8 having a smaller diameter rear shaft portion which may pass through a central hole of an inner sleeve 7 so that the main shaft 8 may be contained in front portion of the inner sleeve. Then, a slidable member 5, a first compression spring 53, a fine steel wire 31, a transmission shaft 4, a clutch seat 174, a clutch 172, and a fine pipe 3 are sequentially put onto the smaller diameter shaft portion of the main shaft 8 after it extends backwardly into the rear portion of the inner sleeve 7. And then, a rotation collar 6 and an outer sleeve 2 are put onto the outside of the inner sleeve 7. Females threads 72 formed on the inner wall of the rear end of the inner sleeve 7 may engage with male threads 11 formed on the front end of handle 1 and thereby fix all parts contained in the inner sleeve 7.

Further, a second compression spring 74, an adjusting sleeve 9 and a slidable collar 85 are put onto the front portion of the main shaft 8. The slidable collar 85 is fitly associated with a fixed collar 86 and, together with a third compression spring 87 and a retaining means 88 which may fitly catch an annular groove 89 formed on the front end of the main shaft 8, forms a clamp head for clamping a screwdriver. Since the portion of clamp head are well known, it will not be discussed herein.

Further referring FIG. 1, the inner sleeve 7 has two elongated side openings 71 extending halfway from its front portion toward it rear end to serve as a backward movements of the slidable member 5 may control the compressive force of the first compression spring 53 and thereby declines the twisting force needed to tightly fasten a screw. Meanwhile, the twisting force may be known and easily set by observing the scales 52 on the slidable member 5 through a clear tube portion 21 of the outer sleeve 2.

Figure 5:
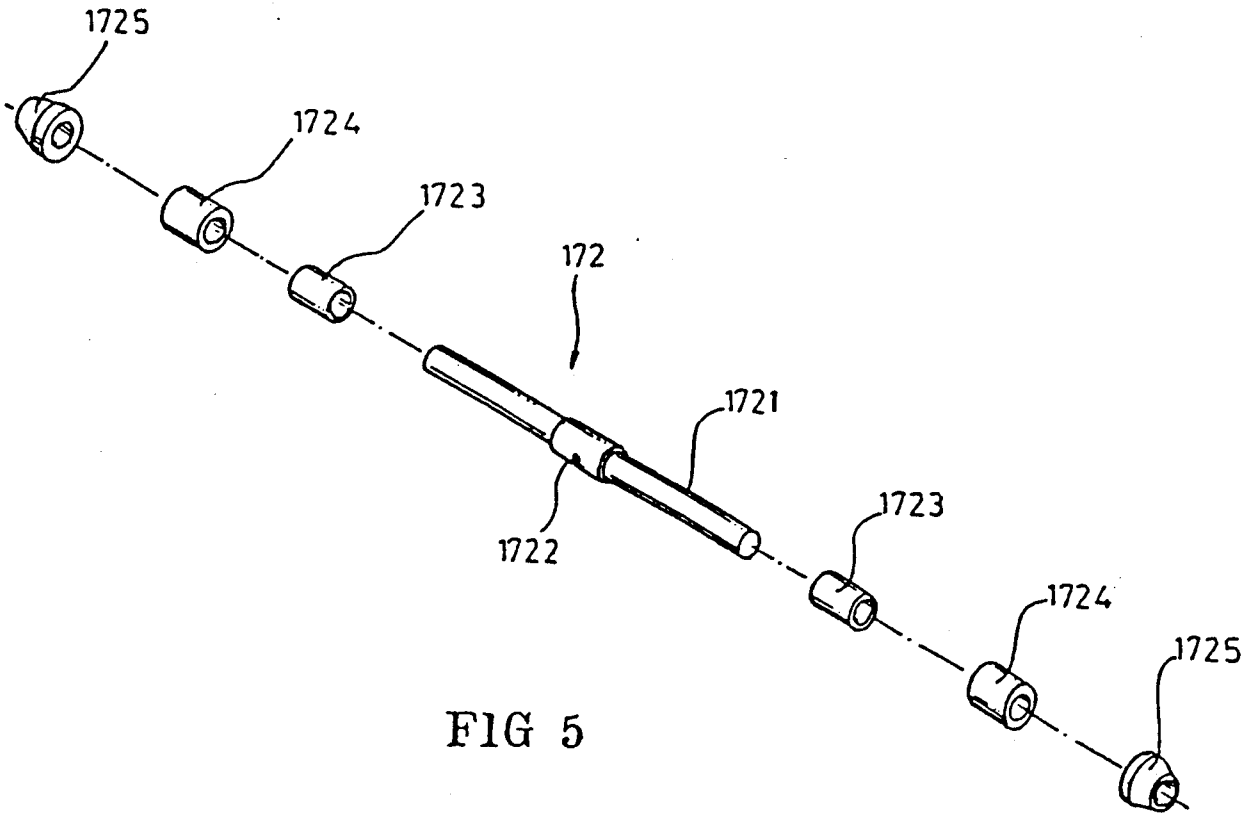
FIG. 5 is a three-dimensional analytical perspective view of the clutch of the present invention illustrating the manner in which each collar and roller are assembled to the central shaft.

As can be seen in FIG. 5, the clutch 172 consists of a central shaft 1721, two smaller collars 1723, two larger collars 1724 and two rollers 1725. A proper length of larger diameter is formed in the middle portion the central shaft 1721 while a through hole 1722 just permitting a fine steel wire to pass through is formed at the center of this larger diameter section. The two smaller and two larger collars 1723, 1724, and the two rollers 1725 have the same inner diameter and thereby may be bilaterally and symmetrically put onto the central shaft sequentially to form a complete clutch 172.

The clutch 172 is seated in the clutch seat 174. A dent 45 formed at the rear end of the transmission shaft 4 may just receive and clamp the smaller collars 1723 of the clutch 172 when it passes through a central opening of the clutch seat 174.

Referring to FIG. 1 again, the transmission shaft 4 has an elongated central blind hole 42 formed at its front end and extending backward proper depth into the transmission shaft 4. A tiny through hole 43 is formed on the bottom center of the central blind hole 42 permitting a fine steel wire to pass through. Two side fluted 41 with proper depth and width are further formed at the front end of the transmission shaft 4 while an annular groove 47 is formed outside the front end thereof to permit a retainer means 44 to clamp thereto. When the smaller diameter rear shaft portion of the main shaft 8 is inserted into the central blind hole 42 with a pin 82 inserted into a through hole 81 formed at it rear end, and the central blind hole 42 is clamped by the retaining means 44 at the annular groove 47, the pin 82 may slidably move in the flutes 41 while causes the main shaft 8 to synchronously rotate with the transmission shaft 4.

The front end of the fine steel wire 31 is wound into a smaller compression spring 311 which can be pressed against the rear top of the main shaft 8, and the other straight end of the fine steel wire 31 passes the tiny through hole 43 formed on the bottom center of the central blind hole 42, the through hole 1722 at the center of the clutch 172, the fine pipe 3, and the central hole 171 of the rotation head 17, and extends into the handle 1 while it stops at somewhere before the contact switch 12. When the main shaft 8 receives resistance while the whole screwdriver is pushed forward, it will pass force to the smaller compression spring 311 and consequently pushes the fine steel wire 31 to move backward and thrusts against the contact switch 12 which in turn artuates the motor 19 and causes the main shaft 8 to rotate; when the resistance from screw being tightened to the main shaft 8 is stopped, the fine steel wire 31 will consequently leave the contact switch 12 and cut the power.

The outer diameter of the fine pipe 3 is larger than the diameter of the through hole 1722, so that it will not insert into the hole 1722 or block the same. The distance between the two larger collars 1724 of the clutch 172 matches that between the two inward arcuate dents formed on the rotation head 17 so that the two dents may just seat onto the two larger collars 1724 separately and thereby drives the whole clutch 172 to rotate when the power is on. The two outer rollers 1725 of the clutch 172 directly contact the inner bottom surface of the clutch seat 174 and may rotatively roll therein. When the rotation head 17 is turned, it will drive the clutch 172 to rotate with the through hole 1722 as a rotation center; at this point, the transmission shaft 4 will rotate synchronously because the smaller collars 1723 of the clutch 172 are clamped by its rear dent 45. Once the screw or bolt being tightened is firmly tightened, the function of the two inward arcuate dents will cause the rotation head 17 to push the clutch 172, transmission shaft 4, and the main shaft 8 to move forward at the same time, which causes the fine steel wire 31 to separate from the contact switch 12 and automatically cut off the power.

Figure 4:
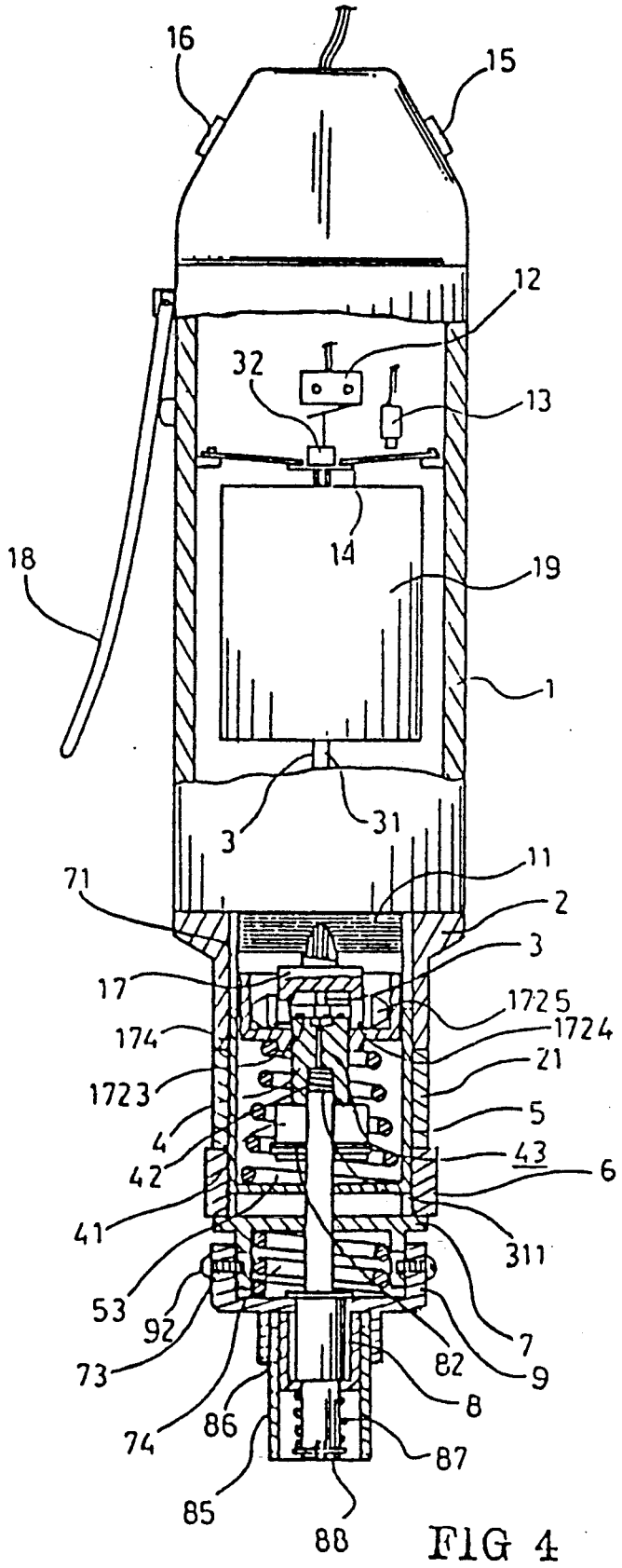
FIG. 4 is another partial longitudinal cross-sectional view of the present invention showing the power supplied is interrupted when the clutch is pushed forward and outward.

To set the screwdriver of the present invention to manual-control mode, an operator disconnects the connection of the second switch 16, then pushes the adjusting sleeve 9 backward and has two adjusting screws 92 to fix the adjusting sleeve 9 at backward position by tightening the two adjusting screws into two L-shaped slots 73 formed at two sides of the front portion of the inner sleeve 7 (as shown in FIG. 4). By this way, the main shaft 8 may backward push the fine steel wire 31 to contact the contact switch 12. At this point, due to the disconnection of the second switch 16, power can be supplied only when a press rod 18 provided at one side of the handle 1 is depressed, i.e. the screwdriver of the present invention may be operated manually at this time.

As shown in FIG. 4, when the rotation head 17 pushes the clutch 172 forwardly, the two spring plates 14 will depress the fixing cap 32 as well as the fine pipe 3 inserted into the fixing cap 32 which causes the spring plates 14 to depart from the second contact switch 13 and cuts off the power therefrom, the rotation head 17 is stoped rotating, accordingly. Since the other end of the fine pipe 3 pushes against the center of the clutch 172, it may move forward or backward following movement of the clutch 172 and further controls movement of the two spring plates 14 as its contact with the contact switch 13.

We claim:

1. An electrical screwdriver which turns off automatically when a screw is tightened comprising a handle, a rotation head disposed on the front end of said handle and having two inwardly arcuate dents disposed in opposite directions, said head, and having a central through passage to an inner space of said handle;

a first contact switch means located along a central line of said handle to control the rotary movement of said rotation head;

two downward and radially extending spring plates attached to said handle and located forward of said first contact switch means;

a second contact switch means located adjacent to one of said two spring plates to control the supply of power;

an outer sleeve having a clear glass tube fixedly connected to said front end;

a slender pipe within said handle the fine steel wire having one end thereof wound into a compression spring while the other end thereof extends into said pipe within said handle;

a clutch having a central shaft with a larger diameter at its middle section than at its ends;

two smaller collars, two larger collars, and two rollers bilaterally and symmetrically attached sequentially to said central shaft, said two larger collars being detachably engaged with said two inwardly arcuate dents on said rotation head;

a clutch seat used to contain said clutch therein;

a transmission shaft having a rear end with a dent and a front end with an elongated central blind hole, wherein said smaller collars of said clutch are received in said rear end within said dent and are clamped thereto, said elongated central blind hole having a tiny through hole formed at its bottoms center permitting said fine steel wire to pass through, said front end of said transmission shaft also having two side flutes;

a shiftable member having two integrally formed long legs;

scales for indicating torsion value disposed on the outer surface of said two legs while male threads are formed at the roots of said two legs;

a first compression spring being located between said shiftable member and said clutch seat;

an inner sleeve having two elongated side openings extending halfway from its front portion toward its rear end to serve as a pair of rails permitting said two legs of said shiftable member to separately slide relative thereto while said male threads formed on the roots of said two legs are exposed, female threads being provided on its inner wall and two L-shaped slots in reversed direction being formed at two sides near its front portion;

a rotation collar on said inner sleeve and having female threads formed on its inner wall to engage with said male threads on said shiftable member;

a second compression spring being positioned into a cylindrical space formed at a front end of said inner sleeve;

a main shaft having a rear shaft portion being provided with a through hole with a pin extending therethrough;

said main shaft extending within said inner sleeve;

an adjusting sleeve having a larger diameter section formed at its rear portion then at its front portion, at two sides of said larger diameter section, two screws being provided to firmly screw into said adjusting sleeve; and a fixing cap covering a terminal end of said fine wire and in engagement with said two spring plates.

2. An electrical screwdriver which turns off automatically when a screw is tightened as claimed in claim 1, wherein said pin through the rear end of said main shaft slidably moves in said two side flutes formed on said transmission shaft when said main shaft extends into said transmission shaft and thereby associates with said transmission shaft to allow the transmission of rotation force to said main shaft.

3. An electrical screwdriver which turns off automatically when a screw is tightened as claimed in claim 1, wherein said two screws provided at two sides of said adjusting sleeve screw through said two L-shaped slots formed on the front portion of said inner sleeve to permit said adjusting sleeve to be screwed thereto after the sleeve is shifted either forwardly or backwardly.

* * * * *